US011187111B2

(12) United States Patent
Le Gall et al.

(10) Patent No.: US 11,187,111 B2
(45) Date of Patent: Nov. 30, 2021

(54) TOOL FOR REMOVING AN ANNULAR PART OF A TURBOMACHINE

(71) Applicant: SAFRAN AIRCRAFT ENGINES, Paris (FR)

(72) Inventors: Rémy Le Gall, Moissy-Cramayel (FR); Grégory Hebert, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/958,523

(22) PCT Filed: Dec. 18, 2018

(86) PCT No.: PCT/FR2018/000276
§ 371 (c)(1),
(2) Date: Jun. 26, 2020

(87) PCT Pub. No.: WO2019/129942
PCT Pub. Date: Jul. 4, 2019

(65) Prior Publication Data

US 2021/0054764 A1 Feb. 25, 2021

(30) Foreign Application Priority Data

Dec. 28, 2017 (FR) ..... 1763296

(51) Int. Cl.
*F01D 25/28* (2006.01)
*B66C 1/10* (2006.01)
*B66C 1/66* (2006.01)

(52) U.S. Cl.
CPC ..... *F01D 25/285* (2013.01); *B66C 1/107* (2013.01); *B66C 1/66* (2013.01)

(58) Field of Classification Search
CPC ..... F01D 25/285; B66C 1/107; B66C 1/66; B66C 1/108
(Continued)

(56) References Cited

U.S. PATENT DOCUMENTS 3,433,459 A * 3/1969 Logan ..... B66C 23/485 254/281
4,433,830 A * 2/1984 Campbell ..... F01D 25/285 254/264
(Continued)

FOREIGN PATENT DOCUMENTS

CN 106966291 A 7/2017
WO WO 2017/001745 A1 1/2017
WO WO 2017/116244 A1 7/2017

OTHER PUBLICATIONS

International Search Report as issued in International Patent Application No. PCT/FR2018/000276, dated Apr. 29, 2019.

*Primary Examiner* — Paul T Chin
(74) *Attorney, Agent, or Firm* — Pillsbury Winthrop Shaw Pittman LLP

(57) ABSTRACT

A tool for removing an annular part mounted around a shaft of a turbomachine, includes a holder configured to cooperate with a lifting system, a system for coupling and holding the annular part, the coupling and holding system being secured to the holder, the system for coupling and holding having an opening designed to receive the shaft of the turbomachine during the removal of the annular part, the coupling and holding system being rotatable with respect to the holder between a first position and a second position by a rotation system for tilting the annular part with respect to the holder when the coupling and holding system is fastened to the annular part.

10 Claims, 5 Drawing Sheets

(58) Field of Classification Search
USPC ..... 294/27.1, 81.3
See application file for complete search history.

(56) References Cited

U.S. PATENT DOCUMENTS

| | | | | |
|---|---|---|---|---|
| 4,460,209 | A | 7/1984 | Lyerly | |
| 5,043,132 | A * | 8/1991 | Schramm | G21C 19/02 376/260 |
| 6,185,817 | B1 * | 2/2001 | Sims | B25B 27/023 29/256 |
| 2016/0222829 | A1 * | 8/2016 | Hulfenhaus | F01D 25/34 |
| 2018/0128181 | A1 * | 5/2018 | Biffle | F02C 7/24 |
| 2018/0172111 | A1 * | 6/2018 | Luinaud | G01M 1/28 |
| 2018/0283215 | A1 * | 10/2018 | Dubois | F01D 25/285 |
| 2018/0306064 | A1 * | 10/2018 | Kolvick | F23R 3/002 |
| 2019/0360361 | A1 * | 11/2019 | Cimen | F01D 25/285 |
| 2020/0025040 | A1 * | 1/2020 | Meyer | F04D 29/644 |
| 2020/0347752 | A1 * | 11/2020 | Porco | B25H 1/0007 |

* cited by examiner

PRIOR ART

TOOL FOR REMOVING AN ANNULAR PART OF A TURBOMACHINE

CROSS-REFERENCE TO RELATED APPLICATIONS

This application is the U.S. National Stage of PCT/FR2018/000276, filed Dec. 28, 2018, which in turn claims priority to French patent application number 1763296 filed Dec. 28, 2017. The content of these applications are incorporated herein by reference in their entireties.

TECHNICAL FIELD OF THE INVENTION

The invention pertains to the general field of turbomachines. More specifically, the invention relates to a tool suited for the dismantling of an annular part of a turbomachine, notably a low pressure turbine disk.

TECHNOLOGICAL BACKGROUND OF THE INVENTION

The general structure of a turbomachine 1 is shown schematically in FIG. 1.

With reference to FIG. 1, the turbomachine 1 of longitudinal axis X comprises, from upstream to downstream, a fan 2, a low pressure compressor 3, a high pressure compressor 4, a combustion chamber 5, a high pressure turbine 6 and a low pressure turbine 7. The low pressure turbine 7 is mechanically connected to an axial shaft 8 driving the fan 2 and the low pressure compressor 3. It is noted that upstream and downstream are defined with respect to the normal direction of flow of gas (symbolised by an arrow) through the turbomachine 1.

The low pressure turbine 7 comprises one or more turbine stages, each turbine stage being composed of a stator and a rotor. The rotor comprises a disk 10 bearing on its outer periphery vanes 11, visible in FIG. 8, the roots of which are engaged in grooves of the outer periphery of the disk 10. Furthermore, each vane 11 comprises a platform 12, visible in FIG. 2, borne by the root of said vane 11.

However, the platforms 12 of the vanes 11 wear rapidly which may, in certain cases, lead to the overlapping of the platforms 12, as may be seen in FIG. 2. When such an overlapping is observed, and if it is not possible to put back in place the vanes 11 on the assembled turbomachine 1 manually, it is necessary to dismantle the disk 10 of the low pressure turbine 7 in order to be able to replace the damaged vane(s) 11.

The turbomachine 1 is divided into so-called major modules, themselves comprising so-called minor modules. Such a division facilitates the mounting and the dismantling of the turbomachine 1. With reference to FIG. 1, the turbomachine 1 comprises, from upstream to downstream, a first major module A (or fan section), a second major module B (or high pressure body) and a third major module C (or low pressure turbine section). The major module C comprises three sub-modules, a first sub-module comprising the rotor and the stator of the turbine 7, a second sub-module comprising the axial shaft 8, and a third sub-module comprising an exhaust casing 14.

In order to replace a vane 11 of the low pressure turbine 7, the third major module C is completely dismantled. The procedure used for the dismantling of the disk 10 of the low pressure turbine 7 is shown schematically in FIGS. 3*a* to 3*g* and comprises:

- a first step, visible in FIG. 3*b*, wherein the major module C is separated from the remainder of the turbomachine positioned horizontally,
- a second step, visible in FIG. 3*c*, wherein the major module C is positioned vertically on a first frame 13,
- a third step, visible in FIG. 3*d*, wherein the exhaust casing 14 is extracted from the major module C,
- a fourth step, visible in FIG. 3*e*, wherein the axial shaft 8 is removed,
- a fifth step, visible in FIG. 3*f*, wherein the first sub-module is positioned on a second frame 15,
- a sixth step, visible in FIG. 3*g*, wherein the disk 10 is extracted from the first sub-module.

It is noted that when the terms "horizontal" and "vertical" positioning of the turbomachine are used, it is taken to mean the position of the turbomachine or a portion of the turbomachine wherein its longitudinal axis X is, respectively, parallel and perpendicular to the support on which said turbomachine rests.

The procedures for dismantling then reassembling the disk 10 of the low pressure turbine 7 are thus complex, long and costly. In addition, the dismantling of the third major module C may expose certain sensitive parts such as roller bearings (not represented), which risk being damaged.

Furthermore, as may be seen in FIGS. 3*a* to 3*g*, the procedure for dismantling the disk 10 necessitates the use of different tools, which brings about additional costs.

Thus, to date, procedures and/or tooling making it possible to ensure dismantling and reassembly of a low pressure turbine disk that are simple, rapid and inexpensive do not exist.

GENERAL DESCRIPTION OF THE INVENTION

The invention makes it possible to reduce the aforementioned drawbacks by proposing a solution making it possible to dismantle easily, rapidly and at lower cost an annular part of a turbomachine, notably a low pressure turbine disk.

Thus, the invention according to a first aspect relates to a tool for dismantling an annular part mounted around a turbomachine shaft comprising:

- a support,
- means for fastening and maintaining the annular part, said fastening and maintaining means being integral with the support and having an opening suited to receiving the shaft of the turbomachine.

"Annular part" is taken to mean a part having a circular through cavity.

During the dismantling of the annular part, the tool according to the invention is positioned facing the annular part to extract such that the opening arranged in the fastening and maintaining means is traversed by the shaft of the turbomachine. It is noted that the opening is traversed by the shaft uniquely when it projects with respect to the annular part during dismantling. The fastening and maintaining means are fixed on the annular part which is next extracted from the remainder of the turbomachine by axially displacing the tool outwards.

The use of the tool according to the invention makes it possible to simplify the procedure for dismantling the annular part while reducing the time and the costs necessary for dismantling. Indeed, when the tool is used to dismantle a disk of the low pressure turbine, this makes it possible to do without the steps of:

- extraction of the third major module C,
- vertically positioning the third major module C on a first frame, extracting the axial shaft, vertically positioning the first sub-module on a second frame.

The dismantling of the disk only necessitates extracting, beforehand, the exhaust casing of the turbomachine positioned downstream of the disk in such a way as to access the disk. The tool is next positioned opposite the disk in order to fix the fastening and maintaining means on the disk. Once the fastening and maintaining means have been fixed on the disk, a simple axial displacement of the tool outwards makes it possible to separate the disk from the remainder of the turbomachine. It is noted that after the removal of the exhaust casing, the shaft of the turbomachine is projecting with respect to the disk. Thus, during the positioning of the tool, the shaft traverses the opening arranged in the fastening and maintaining means until the latter are sufficiently close to the disk to enable the fixing of the tool on the disk. The presence of the opening arranged in the fastening and maintaining means thus makes it possible to extract the annular part without having to extract beforehand the shaft on which the annular part is mounted. It is also noted that the dismantling of the exhaust casing may be carried out using the same tool, which makes it possible to reduce costs.

Furthermore, the dismantling tool according to the invention makes it possible to facilitate the reassembly of the disk and the exhaust casing since there are fewer parts to assemble on the turbomachine. The procedure for reassembling the disk and the exhaust casing is thus less long and less expensive.

Moreover, certain sensitive parts, such as bearings, no longer risk being exposed during dismantling because it is no longer necessary to completely dismantle the third major module C.

Apart from the characteristics that have been set out in the preceding paragraph, the dismantling tool according to the invention may have one or more additional characteristics among the following, considered individually or according to all technically possible combinations thereof.

In a non-limiting embodiment, the fastening and maintaining means are rotationally moveable with respect to the support between:

a first position, wherein the fastening and maintaining means are substantially parallel to the support, a second position, wherein the fastening and maintaining means are substantially perpendicular to the support.

In a non-limiting embodiment, the tool comprises means for rotating the fastening and maintaining means with respect to the support, said rotating means being positioned between the support and the fastening and maintaining means.

In a non-limiting embodiment, the fastening and maintaining means are arranged on a peripheral portion of the support to allow the rotation of the fastening and maintaining means with respect to the support when the annular part is fixed to the fastening and maintaining means.

In a non-limiting embodiment, the rotating means comprise locking means suited to maintaining the fastening and maintaining means in the first position and in the second position.

In a non-limiting embodiment, the fastening and maintaining means are formed by a collar comprising through orifices suited to receiving first fixing means.

In a non-limiting embodiment, the tool comprises second fixing means suited to coupling the fastening and maintaining means and the annular part and cooperating with the fastening and maintaining means in such a way as to fix the fastening and maintaining means on the annular part.

In a non-limiting embodiment, the tool comprises means for adjusting the centre of gravity of the tool.

In a non-limiting embodiment, the adjustment means are formed by:

a ring, a worm screw, a control wheel enabling, by actuating the worm screw, the axial translation of the ring.

Furthermore, the invention according to a second aspect relates to a method for dismantling and upkeeping an annular part mounted around a turbomachine shaft having a longitudinal axis, using the tool according to the first aspect of the invention. The dismantling method comprising the following steps:

positioning the tool opposite the annular part such that the opening of the fastening and maintaining means is facing a central cavity of the annular part, the fastening and maintaining means being maintained in the first position, fixing the fastening and maintaining means on the annular part, displacing the tool axially outwards in such a way as to separate the annular part from the remainder of the turbomachine, placing the annular part, fixed to the tool, on a frame to carry out the upkeep of the annular part, the fastening and maintaining means being maintained in the second position.

Finally, the invention according to a third aspect relates to a method for reassembling an annular part around a turbomachine shaft having a longitudinal axis using the tool according to the first aspect of the invention. The method according to the third aspect comprising the following steps:

switching the fastening and maintaining means to the first position by the rotating means, positioning the tool fixed to the annular part facing the shaft of the turbomachine such that said shaft can traverse the opening arranged in the fastening and maintaining means, displacing the tool axially until the annular part returns to an initial position around the shaft, disengaging the fastening and maintaining means from the annular part, extracting the tool from the turbomachine by axially displacing the tool to the outside of the turbomachine.

BRIEF DESCRIPTION OF THE FIGURES

The figures are only presented for indicative purposes and are in no way limiting. The figures show.

Other characteristics and advantages of the invention will become clear from reading the detailed description that follows, with reference to the appended figures.

DESCRIPTION OF AT LEAST ONE EMBODIMENT OF THE INVENTION

FIGS. 5 to 9 represent the dismantling tool 100 according to a non-limiting embodiment of the invention.

Figure 5:
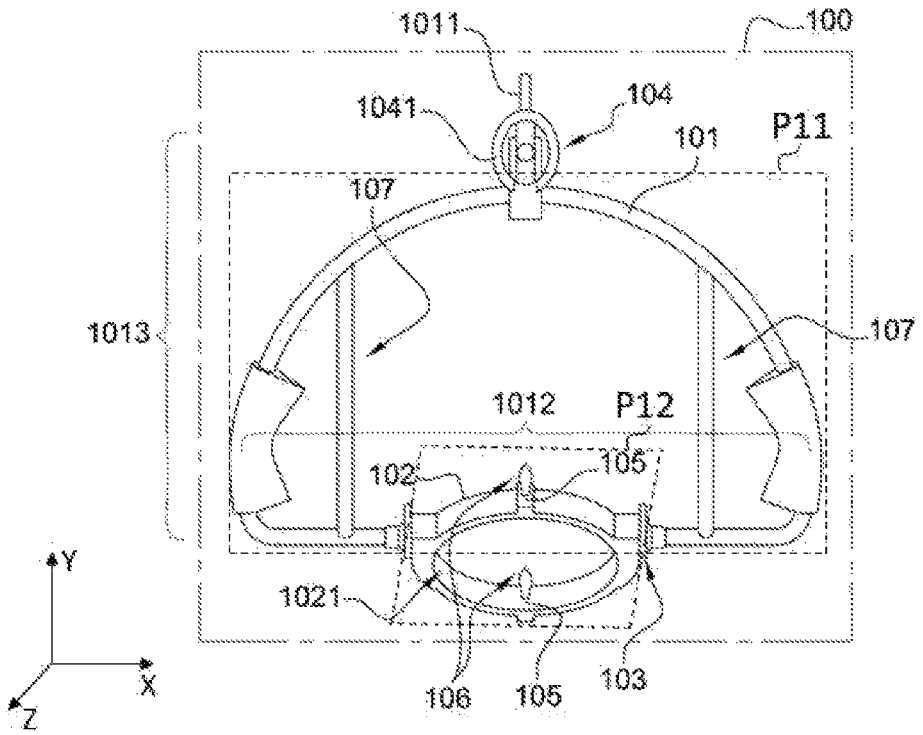

With reference to FIG. 5, the dismantling tool 100 comprises:

a support 101, fastening and maintaining means 102, rotating means 103, adjustment means 104.

The support 101 is suited to supporting an annular part 10, 14 of a turbomachine 1 when said annular part 10, 14 is fixed to the fastening and maintaining means 102. The annular part 10, 14 is for example a disk 10 of the low pressure turbine 7 such as represented in FIGS. 6 to 9 or instead an exhaust casing 14, etc. "Disk" is taken to mean a disk without vanes or a disk on which vanes are mounted.

The shape, the dimensions and the material of the support 101 are chosen such that the support 101 has sufficient mechanical strength so as not to break during the dismantling, the reassembly or the upkeep of the annular part 10, 14. "Upkeep" is notably taken to mean the replacement of a vane. Advantageously, the support 101 is made of steel. Furthermore, as may be seen in FIG. 5, the support 101 is perforated, which makes it possible to limit the manufacturing costs of the tool 100.

Moreover, according to the embodiment shown in FIG. 5, the support 101 has a semi-circular shape composed of a base 1012 and a half-circle portion 1013. According to an embodiment, the base 1012 extends over a length comprised in the interval [662 mm; 1862 mm], preferentially 1312 mm. Obviously, the support 101 may have other shapes such as a circular, rectangular, square, triangular shape, etc. Moreover, the support 101, whatever its shape, extends mainly along a plane, which will be designated first plane P11. In other words, when the support 101 has a semi-circular shape, the base 1012 and the half-circle portion 1013 both extend along the first plane P11. The first plane P11 is vertical when the tool 100 is used for the dismantling, the upkeep or the reassembly of the annular part 10, 14. The terms "vertical plane" and "horizontal plane" are defined with reference, respectively, to the plane XY and to the plane XZ of the reference system XYZ illustrated in FIG. 5.

In addition, the support 101 comprises means for retaining 107 the annular part 10, 14 visible in FIG. 5. The retention means 107 make it possible to prevent the annular part 10, 14 from switching during the dismantling or the reassembly of said annular part 10, 14. In addition, the retention means 107 also serve as reinforcement for the tool 100. For this purpose, the retention means 107 are arranged in such a way as to form a bearing surface for the annular part 10, 14 when it is fixed on the tool 100. According to the embodiment of FIG. 5, the retention means 107 are formed by two vertical bars arranged on either side of the fastening and maintaining means 102 and extend perpendicularly with respect to the base 1012. Moreover, each bar is connected, by a first end, to the base 1012 and, by a second end, to the half-circle portion 1013 of the support 101. Obviously, the retention means 107 may have other shapes not represented in the figures.

Figure 8:
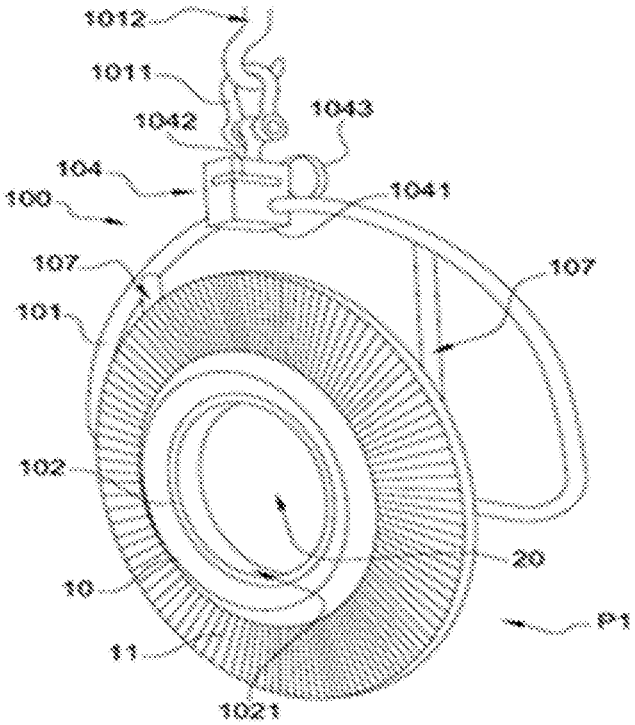

Advantageously, the tool 100 also comprises gripping means 1011 making it possible to grab, maintain and displace the tool 100 during the dismantling, the reassembly or the upkeep of the annular part 10, 14, for example using a lifting system. In the embodiment illustrated in FIG. 5, the gripping means 1011 are formed by a loop, arranged at the summit of the half-circle portion 1013, wherein is inserted a hook 1012 of the lifting system, such as illustrated in FIG. 8.

Furthermore, the fastening and maintaining means 102 ensure the fixing of the tool 100 on the annular part 10, 14 during the dismantling, the upkeep or during the reassembly of the annular part 10, 14. For this purpose, through orifices 105 are arranged in the fastening and maintaining means 102 and are suited to receiving first fixing means 106. According to a non-limiting embodiment, the first fixing means 106 cooperate with second fixing means (not represented) of the tool 100 to ensure the fixing of the fastening and maintaining means 102 on the annular part 10, 14. Advantageously, the second fixing means are formed by removable hooks which enable the coupling of the annular part 10, 14 with the fastening and maintaining means 102.

According to the embodiment of FIG. 5, the first fixing means 106 are formed by fixing screws which are introduced in the through orifices 105 arranged in the fastening and maintaining means 102 until coming into contact with the removable hooks. The tightening of the fixing screws on the removable hooks makes it possible to press the fastening and maintaining means 102 against the annular part 10, 14 to make them correctly integral with each other. The use of removable hooks makes it possible to ensure the integrity of the annular part 10, 14 in so far as it is not necessary to drill holes in the annular part 10, 14 to fix it to the tool 100.

Figure 7:
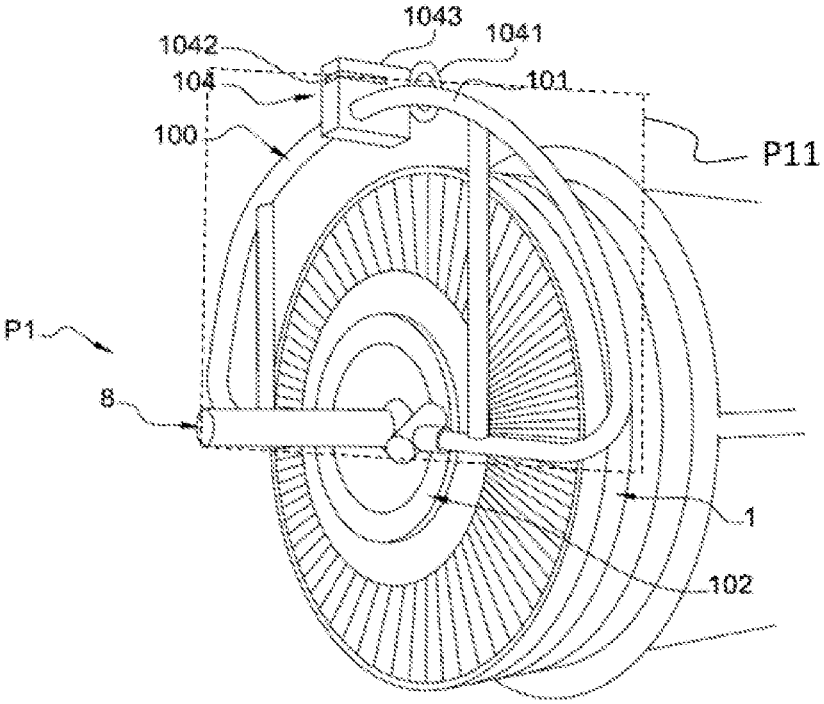

Furthermore, the fastening and maintaining means 102 comprise a through opening 1021 of which the shape and the dimensions are suited to receiving an axial shaft 8 of the turbomachine 1, visible in FIG. 7, during the dismantling and the reassembly of the annular part 10, 14. Moreover, the opening 1021 enables the centring of the fastening and maintaining means 102 on the inner diameter of the annular part 10, 14. According to a non-limiting embodiment, the opening 1021 is circular and has a diameter comprised in the interval [400 mm, 600 mm], preferentially 450 mm. Advantageously, the fastening and maintaining means 102 are interchangeable such that it is possible to substitute them by fastening and maintaining means of different diameters.

According to the embodiment of FIGS. 5 to 9, the fastening and maintaining means 102 are in the form of a collar. Obviously, the fastening and maintaining means 102 may have another shape, for example square, rectangular. Moreover, the fastening and maintaining means 102, whatever their shape, extend mainly along a plane, which will be designated second plane P12.

In an advantageous manner, the characteristics of the fastening and maintaining means 102, notably the material (s) and/or the protective elements used, are chosen in such a way as to avoid any damage of the annular part 10, 14. Thus, the fastening and maintaining means 102 are made of a material having sufficient strength to support the annular part 10, 14 when it is fixed on the fastening and maintaining means 102. Advantageously, the fastening and maintaining means 102 are made of steel.

Furthermore, the fastening and maintaining means 102 are rotationally moveable with respect to the support 101 between a first position P1 and a second position P2.

Figure 6:
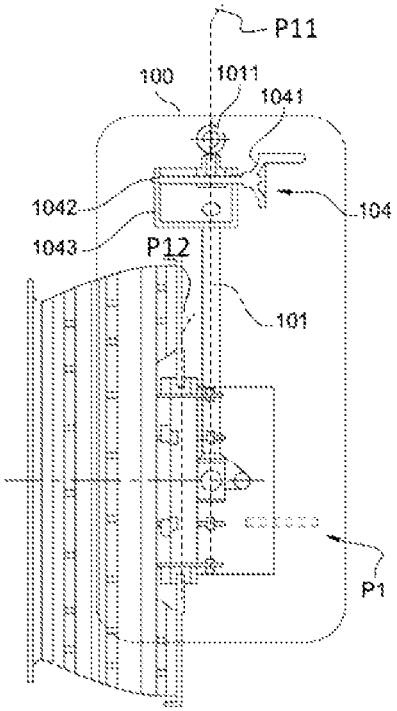

In the first position P1, illustrated in FIGS. 6 to 8, the fastening and maintaining means 102 are substantially parallel to the support 101, i.e. the first plane P11 is substantially parallel to the second plane P12. Moreover, in this position P1, the first plane P11 and the second plane P12 are substantially vertical. Advantageously, the fastening and maintaining means 102 are in the first position P1 during the dismantling and the reassembly and in the second position P2 during the upkeep of the annular part 10, 14.

Figure 9:
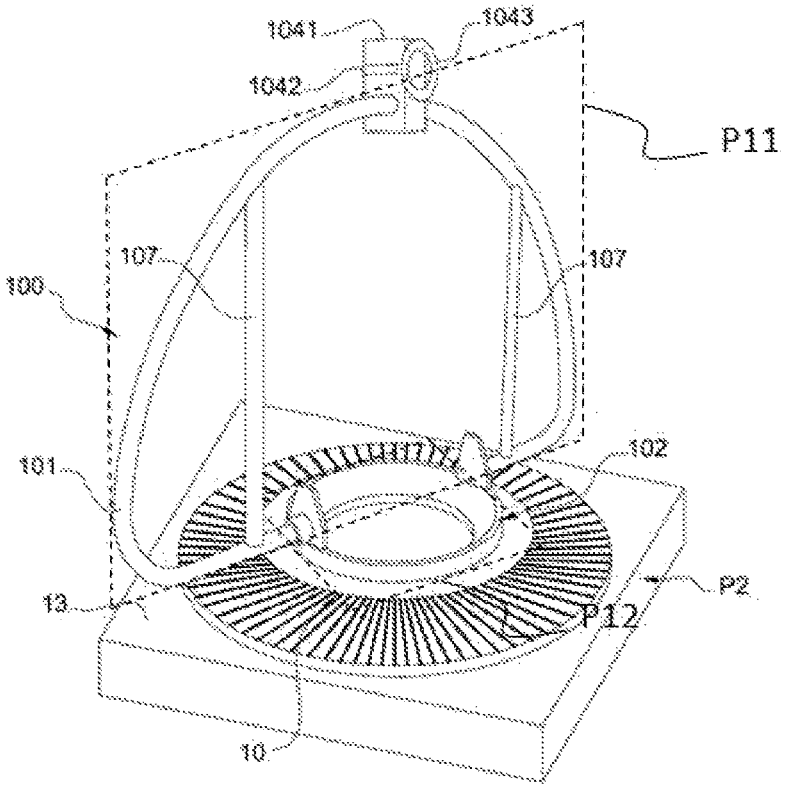

In the second position P2, illustrated in FIG. 9, the fastening and maintaining means 102 are substantially perpendicular to the support 101, i.e. the first plane P11 is substantially perpendicular to the second plane P12. Moreover, in this position P2, the first plane P11 is vertical whereas the second plane P12 is horizontal.

Furthermore, according to a non-limiting embodiment, the fastening and maintaining means 102 are arranged on a peripheral portion of the support 101 in such a way as to allow the rotation of the fastening and maintaining means 102 with respect to the support 101 when the annular part 10, 14 is fixed to the fastening and maintaining means 102. According to the embodiment shown in FIG. 5, the fastening and maintaining means 102 are positioned at the level of the base 1012 of the support 101. In other words, the base 1012 has a discontinuity at the level of which the fastening and maintaining means 102 are positioned.

The rotating means 103 ensure the rotation of the fastening and maintaining means 102 with respect to the support 101 in such a way as to enable the passage from the first position P1 to the second position P2, and vice versa. In particular, the passage from the first position P1 to the second position P2 is carried out by switching the fastening and maintaining means 102 or the annular part 10, 14 (when it is fixed to the fastening and maintaining means 102) by an angle of 90° with respect to the support 101.

The rotating means 103 are positioned between the support 101 and the fastening and maintaining means 102. According to a non-limiting embodiment, the rotating means 103 are composed of a spindle and a collar forming a pivot link. Naturally, the rotating means 103 may be formed by any system making it possible to form a pivot link, for example a roller.

Furthermore, the rotating means 103 comprise locking means suited to maintaining the fastening and maintaining means 102 in the first position P1 or in the second position P2. The locking means are for example formed by a pinning at 0° and 90°.

The adjustment means 104 are suited to modifying the centre of gravity of the tool 100, in particular when the annular part 10, 14 is fixed to the tool 100 in order to ensure the stability of the annular part 10, 14 during the dismantling and the reassembly of the annular part 10, 14. According to a non-limiting embodiment, the adjustment means 104 are formed by a mechanical axial displacement means comprising:

- a ring 1041,
- a worm screw 1042,
- a control wheel 1043 enabling, by actuating the worm screw 1042, the axial translation of the ring 1041.

In an alternative embodiment of the invention, the adjustment means 104 are formed by an electric, hydraulic displacement means or any other axial displacement means.

Figure 10:
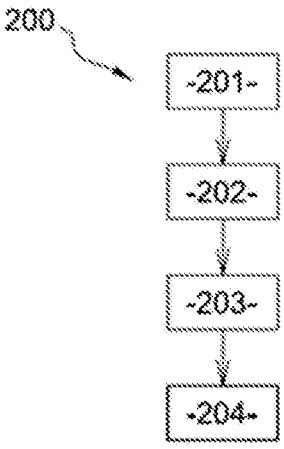

FIG. 10 represents the steps of the method 200 for dismantling an annular part 10, 14 mounted around a shaft 8 of a turbomachine 1 using the tool 100 according to the invention. During the dismantling of the annular part 10, 14, the turbomachine or a portion of the turbomachine is positioned horizontally, i.e. the longitudinal axis X, visible in FIG. 4*a*, of the turbomachine or of the portion of the turbomachine is parallel to the plane XZ of the reference system XYZ illustrated in FIG. 5.

In a positioning step 201, the tool 100 is positioned facing the annular part 10, 14 such that the opening 1021 of the fastening and maintaining means 102 is facing a central cavity 20 of the annular part 10, 14. The fastening and maintaining means 102 are maintained in the first position P1 during the positioning step 201. Advantageously, the fastening and maintaining means 102 are locked in the first position P1 by the locking means. Furthermore, when the shaft 8 of the turbomachine 1 is projecting with respect to the annular part 10, 14, the step of positioning 201 the tool 100 comprises the positioning of the opening 1021 of the fastening and maintaining means 102 around the shaft 8 then the axial displacement of the tool 100 inwards, i.e. in the direction of the annular part 10, 14.

In a fixing step 202, the fastening and maintaining means 102 are fixed on the annular part 10, 14. Advantageously, the fixing step 202 is carried out by positioning beforehand the second fixing means against the fastening and maintaining means 12 and the annular part 10, 14 in such a way as to ensure their coupling. The first fixing means 106, here formed by fixing screws, are next inserted through the through orifices 105 arranged in the fastening and maintaining means 102 then tightened against the removable hooks to fix correctly the fastening and maintaining means 102 and the annular part 10, 14.

In a displacement step 203, the tool 100 fixed to the annular part 10, 14 is displaced axially outwards in such a way as to separate the annular part 10, 14 from the remainder of the turbomachine 1. It is noted that "axial" displacement is taken to mean a displacement along a direction parallel to the axis X of the turbomachine 1.

In an upkeep step 204, the annular part 10, 14, fixed to the tool 100, is placed on a frame 13 in order to carry out the maintenance of the annular part 10, 14 as may be seen in FIG. 9. During the upkeep step 201, the fastening and maintaining means 102 are maintained in the second position P2. To do so, the fastening and maintaining means 102 are switched to the second position P2 by the rotating means 103. Advantageously, the upkeep step 204 comprises the locking of the fastening and maintaining means 102 in the second position P2 by the locking means. It is noted that if the fastening and maintaining means 102 have been locked in the first position P1 during the positioning step 101, it is necessary to unlock the position of the fastening and maintaining means 102 in order to be able to make it switch to the second position P2. Furthermore, in order to facilitate the step of upkeeping 204 the annular part 10, 14, the fastening and maintaining means 102 may be disengaged from the annular part 10, 14.

Figure 1:
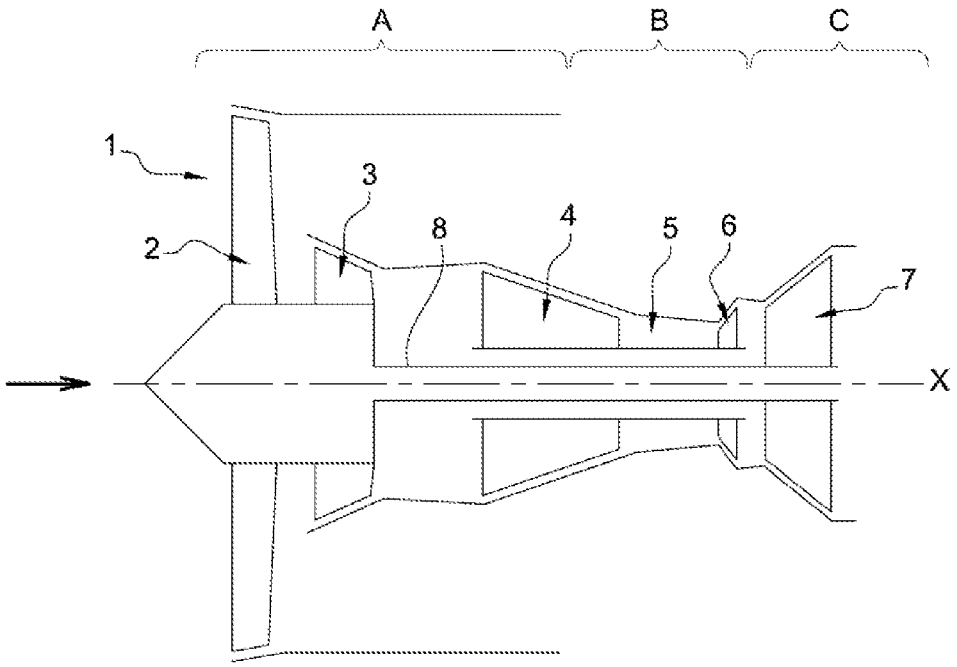
in FIG. 1, a schematic view in longitudinal section of a turbomachine, in FIG. 2, two adjacent vanes of which the platforms overlap, in FIGS. 3*a* to 3*g*, the steps of the method for dismantling a turbomachine disk according to the prior art, in FIGS. 4*a* to 4*c*, the steps of the method for dismantling a turbomachine disk using the tool according to the invention, in FIG. 5, the dismantling tool according to an embodiment of the invention, in FIG. 6, a view in longitudinal section of the tool illustrated in FIG. 5 when it is fixed on a turbomachine disk, the fastening and maintaining means being in the first position, in FIG. 7, a view from the upstream of the tool of FIG. 6 when it is positioned on the turbomachine, in FIG. 8, a perspective view of the tool of FIG. 7, after the dismantling of the disk, in FIG. 9, the tool according to the invention during the upkeep of the disk, the fastening and maintaining means being in the second position, in FIG. 10, a block representation of the steps of the method for dismantling an annular part according to an embodiment of the invention, in FIG. 11, a block representation of the steps of a method for reassembling the annular part according to an embodiment of the invention.
Figure 2:
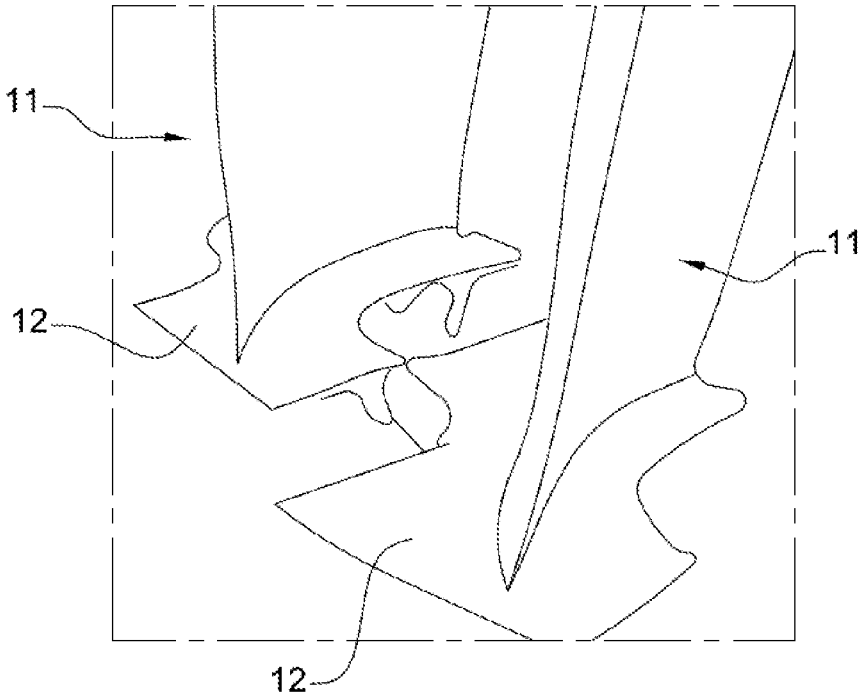
Figures 3A, 3B, 3C, 3D, 3E, 3F, 3G:
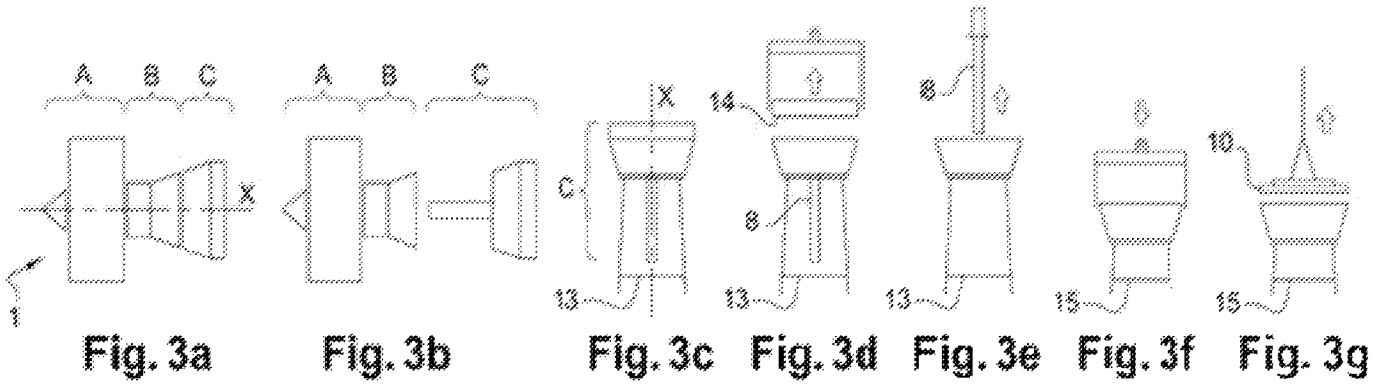
Figures 4A, 4B, 4C:
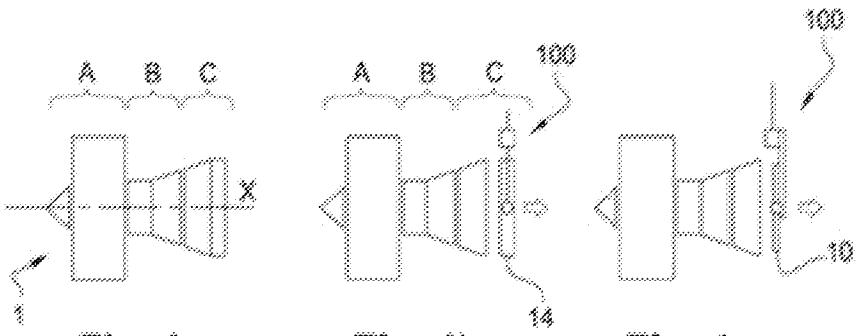

During the dismantling of a disk 10 of a low pressure turbine 7 such as represented in FIGS. 4*a* to 4*c*, the aforesaid dismantling method 200 is carried out a first time to extract the exhaust casing 14 visible in FIG. 4*b* then a second time to extract the disk 10 such as represented in FIG. 4*c*.

Figure 11:
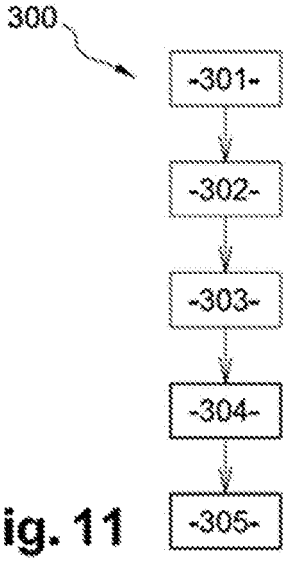

FIG. 11 represents the steps of a method 300 for reassembling the annular part 10 after the dismantling by the method 200.

In a switching step 301, the fastening and maintaining means 102 are switched from the second position P2 to the first position P1 by the rotating means 103. Advantageously, the fastening and maintaining means 102 are locked in the first position P1 by the locking means. It is noted that if the fastening and maintaining means 102 have been locked in the second position P2 before the switching step 301, it is necessary to unlock the position of the fastening and maintaining means 102 before being able to make it switch to the first position P1.

In a positioning step 302, the tool 100 on which is fixed the annular part 10, 14 is positioned facing the turbomachine 1 such that the shaft 8 of the turbomachine can traverse the opening 1021 arranged in the fastening and maintaining means 102. In other words, the opening 1021 of the fastening and maintaining means 102 is positioned facing the turbomachine 1 in such a way as to surround the shaft 8 of the turbomachine 1.

In a displacement step 303, the tool 100 is displaced axially inwards, i.e. towards the turbomachine, until the annular part 10, 14 returns to its initial position in the turbomachine. "Initial position" is taken to mean the position of the annular part 10, 14 before the dismantling of said annular part 10, 14 of the turbomachine 1.

In a disengagement step 304, the fastening and maintaining means 102 are disengaged from the annular part 10, 14.

In an extraction step 305, the tool 100 is extracted by displacing it axially to the outside of the turbomachine 1.

The invention is obviously not limited to the exemplary embodiments described above for which other alternative embodiments could be provided without however going beyond the scope of the invention.

The invention claimed is:

1. A dismantling tool for dismantling an annular part having an axis and mounted around a shaft of a turbomachine, comprising:

a support configured to cooperate with a lifting system, means for fastening and maintaining the annular part, said fastening and maintaining means being integral with the support, the means for fastening and maintaining have an opening configured to receive the shaft of the turbomachine during the dismantling of the annular part, wherein the means for fastening and maintaining are rotationally moveable with respect to the support between a first position and a second position by a rotating means to ensure a switching of the axis of the annular part with respect to the support when the means for fastening and maintaining are fixed to the annular part.

2. The dismantling tool according to claim 1, wherein:

in the first position, the means for fastening and maintaining are substantially parallel to the support, in the second position, the means for fastening and maintaining are substantially perpendicular to the support.

3. The dismantling tool according to claim 1, wherein the rotating means are positioned between the support and the means for fastening and maintaining.

4. The dismantling tool according to claim 1, wherein the means for fastening and maintaining are arranged on a peripheral portion of the support to allow the rotation of the means for fastening and maintaining with respect to the support when the annular part is fixed to the means for fastening and maintaining.

5. The dismantling tool according to claim 1, wherein the rotating means comprise locking means configured to maintain the means for fastening and maintaining in the first position and in the second position.

6. The dismantling tool according to claim 1, wherein the means for fastening and maintaining are formed by a collar comprising through orifices configured to receive first fixing means.

7. The dismantling tool according to claim 1, further comprising means for adjusting the centre of gravity of the tool.

8. A dismantling method for dismantling and upkeeping an annular part having an axis and mounted around a shaft of a turbomachine of longitudinal axis using the dismantling tool according to claim 1, comprising:

positioning the tool opposite the annular part such that the opening of the means for fastening and maintaining is facing a central cavity of the annular part, the fastening and maintaining means being maintained in the first position, fixing the means for fastening and maintaining on the annular part, displacing the tool axially outwards in such a way as to separate the annular part from the remainder of the turbomachine, and placing the annular part, fixed beforehand to the tool, on a frame to carry out the upkeep of the annular part, the fastening and maintaining means being maintained in the second position, wherein the means for fastening and maintaining are rotationally moveable with respect to a support of the dismantling tool between a first position and a second position by a rotating means to ensure a switching of the axis of the annular part with respect to the support when the means for fastening and maintaining are fixed to the annular part.

9. A method for reassembling an annular part around a shaft of a turbomachine of longitudinal axis using the dismantling tool according to claim 1, comprising:

switching the means for fastening and maintaining to the first position by the rotating means, positioning the dismantling tool fixed to the annular part facing the shaft of the turbomachine such that said shaft is adapted to traverse the opening arranged in the means for fastening and maintaining, displacing the dismantling tool axially until the annular part returns to an initial position around the shaft, disengaging the means for fastening and maintaining from the annular part, and extracting the dismantling tool from the turbomachine by axially displacing the dismantling tool towards the outside of the turbomachine, wherein the means for fastening and maintaining are rotationally moveable with respect to a support of the dismantling tool between a first position and a second position by a rotating means to ensure a switching of the axis of the annular part with respect to the support when the means for fastening and maintaining are fixed to the annular part.

10. A dismantling tool for dismantling an annular part mounted around a shaft of a turbomachine, comprising:

a support configured to cooperate with a lifting system, means for fastening and maintaining the annular part, said means for fastening and maintaining being integral with the support, the means for fastening and maintaining having an opening configured to receive the shaft of the turbomachine during the dismantling of the annular part, and means for adjusting the centre of gravity of the tool, wherein the means for fastening and maintaining are rotationally moveable with respect to the support between a first position and a second position by a rotating means to ensure a switching of the annular part with respect to the support when the means for fastening and maintaining are fixed to the annular part, and wherein the means for adjusting are formed by:

a ring, a worm screw, a control wheel enabling, by actuating the worm screw, the axial translation of the ring.

* * * * *